US010264908B2

(12) United States Patent
Hatton et al.

(10) Patent No.: US 10,264,908 B2
(45) Date of Patent: Apr. 23, 2019

(54) CURTAIN SUPPORT/SWIVEL ASSEMBLY

(71) Applicant: CROMPTON VENTURES, LLC, Wilmette, IL (US)

(72) Inventors: Marc Eric Hatton, Wilmette, IL (US); Robert Alfred Blanford, Largo, FL (US); Thomas Allan Fitzgerald, Tulsa, OK (US); Glen Ray Platner, Broken Arrow, OK (US)

(73) Assignee: CROMPTON VENTURES, LLC, Wilmette, IL (US)

( * ) Notice: Subject to any disclaimer, the term of this patent is extended or adjusted under 35 U.S.C. 154(b) by 0 days.

(21) Appl. No.: 15/456,361

(22) Filed: Mar. 10, 2017

(65) Prior Publication Data

US 2017/0273492 A1 Sep. 28, 2017

Related U.S. Application Data

(60) Provisional application No. 62/307,473, filed on Mar. 12, 2016.

(51) Int. Cl.
*A47H 1/102* (2006.01)
*A47H 13/00* (2006.01)
(Continued)

(52) U.S. Cl.
CPC ..... *A47H 13/00* (2013.01); *A47H 1/102* (2013.01); *A47H 13/04* (2013.01); *A47H 15/02* (2013.01); *A47H 15/04* (2013.01)

(58) Field of Classification Search
CPC ..... A47H 13/00; A47H 13/01; A47H 13/02; A47H 13/04; A47H 15/00; A47H 15/02; A47H 15/04; A47H 1/102
See application file for complete search history.

(56) References Cited

U.S. PATENT DOCUMENTS 2,783,493 A * 3/1957 Gussack ..... E05D 15/0634 16/97
2,917,771 A * 12/1959 Labrie ..... E05D 15/063 16/105

(Continued)

FOREIGN PATENT DOCUMENTS

WO WO2012097345 7/2012

OTHER PUBLICATIONS

"Shower Curtain Rail/Rod, 4 way use, L or U shape with ceiling mount and semi-open ring"; https://www.amazon.co.uk/Shower-Curtain-ceiling-semi-open-Chrome/dp/B0009W9AJJC retrieved Jan. 13, 2017.

(Continued)

*Primary Examiner* — Brian D Mattei
(74) *Attorney, Agent, or Firm* — Smith Tempel; Steven P. Wigmore

(57) ABSTRACT

Various embodiments of curtain support and swivel assembly designs are provided. One embodiment is a curtain support assembly comprising a support attachment member and a curtain attachment member. A rod extends from the support attachment member. A stop member is disposed on an end of the rod. The curtain attachment member has a longitudinal opening with a lip. The stop member is configured to be received within the longitudinal opening and positioned such that the stop member engages with the lip and rotates within the longitudinal opening.

20 Claims, 14 Drawing Sheets

(51) Int. Cl.

| | |
|---|---|
| ***A47H 13/04*** | (2006.01) |
| ***A47H 15/02*** | (2006.01) |
| ***A47H 15/04*** | (2006.01) |

(56) References Cited

U.S. PATENT DOCUMENTS

| | | | | |
|---|---|---|---|---|
| 4,408,369 | A * | 10/1983 | Labelle | E04B 2/827 16/102 |
| 5,191,922 | A | 3/1993 | Wade | |
| 5,217,057 | A * | 6/1993 | Hubbard | A47H 5/00 160/123 |
| 5,544,387 | A | 8/1996 | Yamamoto et al. | |
| 6,418,588 | B1 * | 7/2002 | Haab | E05D 15/063 16/87.2 |
| 7,370,839 | B2 | 5/2008 | Putman | |
| 7,431,067 | B2 | 10/2008 | Nien | |
| 7,648,111 | B2 | 1/2010 | Goldstein | |
| 8,046,872 | B2 * | 11/2011 | Burgess, III | E05D 15/0639 16/103 |
| 8,118,078 | B2 * | 2/2012 | Freedland | A47H 1/02 16/87.2 |
| 8,408,275 | B2 | 4/2013 | Dewees et al. | |
| 8,621,680 | B2 | 1/2014 | Maes | |
| 9,032,588 | B2 * | 5/2015 | Chen | E06B 7/28 16/106 |
| 2011/0088231 | A1 | 4/2011 | Henry et al. | |
| 2011/0283479 | A1 * | 11/2011 | Peters | A47H 1/04 16/87.2 |
| 2013/0019395 | A1 | 1/2013 | Pierce | |
| 2013/0082017 | A1 | 4/2013 | Tang | |
| 2015/0208843 | A1 * | 7/2015 | Ruble | A47H 13/02 24/373 |
| 2016/0088977 | A1 | 3/2016 | Hanley | |
| 2016/0242586 | A1 | 8/2016 | Mateer | |
| 2017/0354285 | A1 * | 12/2017 | Kim | A47H 13/02 |

OTHER PUBLICATIONS

"Standard Curtain Hook Carrier Rolls for Hospital Cubicle Curtain Track"; https://www.amazon.com/Standard-Curtain-Carrier-Rollers-Hospital/dp/B00X3K10E4 retrieved Jan. 13, 2017.

"CS Cubicle Curtains"; http://www.c-sgroup.com/cubicle-track-curtains/track_carriers retrieved Jan. 13, 2017.

* cited by examiner

CURTAIN SUPPORT/SWIVEL ASSEMBLY

CROSS-REFERENCE TO RELATED APPLICATIONS

This application claims the benefit of the priority of U.S. Provisional Patent Application Ser. No. 62/307,473 entitled "Quick Release Hook and Swivel System" and filed Mar. 12, 2016, which is hereby incorporated by reference in its entirety.

DESCRIPTION OF RELATED ART

Currently, there are numerous commercial solutions for hanging curtains, drapes, or other materials (referred to as "hanging material") for use as a room divider, to create an enclosed space, or otherwise provide privacy in various applications. The hanging material may comprise any type of textiles, fabrics, cloths, or other flexible materials. Depending on the particular application, the hanging material may be referred to as a cubicle curtain, a hospital curtain, a privacy curtain, a shower curtain, or more generally as a curtain or drape (collectively referred to as "privacy curtains"). For example, hanging movable curtain systems are commonly used in nursing homes, extended care facilities, doctor offices, and other medical treatment facilities to provide patient privacy. The privacy curtains are typically hung using a track system. A track comprising an extruded aluminum or other channel may be attached to a conventional or dropped ceiling, which forms a path around the desired privacy area.

A typical ceiling-mounted track and curtain system employs a series of rollers or gliders that move within the track. A hook may be attached to each roller with, for example, a chain. To drape the privacy curtain around the area defined by the track, each hook is attached to a series of grommets disposed on an upper portion of the privacy curtain. After the hooks have been attached to the grommets, the privacy curtain hangs from the ceiling-mounted track. An individual may pull the privacy curtain to slide it along the track and thereby open and close the privacy area.

Despite their widespread use and commercial success, ceiling-mounted track and curtain systems have many disadvantages. The ceiling-mounted track must generally follow a path that does not block ceiling obstacles (e.g., lights, vents, fire sprinklers, etc.), which may limit the location for optimal use of the rooms and increase custom installation costs. Furthermore, these types of systems may be difficult to install, use, and maintain. Due to the height of the ceiling-mounted track, it may be difficult to repair and clean the track system. Furthermore, a ladder may be required to take down the privacy curtain for maintenance, replacement, and/or cleaning. Because privacy curtains tend to be large in height and length and, therefore, relatively heavy, they can be very cumbersome to hang and take down.

Existing track designs typically use entry and exit points at one or both ends of the track for insertion and removal of the rollers and the curtain. For example, if one roller breaks in the sequence of rollers, all the rollers and the entire curtain up to that point need to be removed from the track in order to replace the broken roller. As known in the art, the rollers may have a relatively short life span due to buildup of materials within the track system. When one or more rollers begin to malfunction, the privacy curtain may no longer smoothly traverse the track, which may cause the privacy curtain to catch or bind and lead to tearing of the hanging material.

Another problem with existing curtain hanging systems is that the hook-to-grommet method tends to fail when hooks are not correctly installed through the grommets. Improperly installed hooks may cause sagging of the hanging material, which can lead to an installer inadvertently failing to connect a hook to the corresponding grommet. In such cases, the privacy curtain may get caught in the track and lock.

Yet another disadvantage of ceiling-mounted track and curtain systems is that they may be required to comply with fire safety standards or regulations. For example, in certain types of health care facilities, there may be material and/or clearance regulations that require the hanging material to be installed some distance below fire sprinklers. To achieve compliance with these and other standards or regulations, many hospital privacy curtains used with ceiling-mounted tracks include a predefined length (e.g., 18 inches) of mesh header as a first upper portion before any solid cloth hanging material. This allows fire sprinklers to work properly in the event of a fire. However, because the mesh is not solid, it tends to get caught in the hooks, which often causes tearing of the mesh. In addition, when the mesh is caught on the hooks, the rollers or gliders may stick in the track, preventing the privacy curtain from working properly.

Accordingly, despite the widespread availability and commercial success of privacy curtains, there remains a need in the art for improved systems, methods, and devices for attaching and/or supporting privacy curtains.

SUMMARY OF DISCLOSURE

Various embodiments of curtain support and swivel assembly designs are provided. One embodiment is a curtain support assembly comprising a support attachment member and a curtain attachment member. A rod extends from the support attachment member. A stop member is disposed on an end of the rod. The curtain attachment member has a longitudinal opening with a lip. The stop member is configured to be received within the longitudinal opening and positioned such that the stop member engages with the lip and rotates within the longitudinal opening.

Another embodiment of a curtain support assembly comprises a rigid support rod and a curtain attachment member. The rigid support rod has a first end configured to removable attachment to a horizontal support structure and a second end comprising a stop member. The curtain attachment member has a longitudinal opening with a lip. The stop member is configured to be received within the longitudinal opening and positioned such that the stop member engages with the lip and enables the rigid support rod to rotate within the longitudinal opening.

BRIEF DESCRIPTION OF DRAWINGS

In the Figures, like reference numerals refer to like parts throughout the various views unless otherwise indicated. For reference numerals with letter character designations such as "102A" or "102B", the letter character designations may differentiate two like parts or elements present in the same Figure. Letter character designations for reference numerals may be omitted when it is intended that a reference numeral to encompass all parts having the same reference numeral in all Figures.

DETAILED DESCRIPTION

Figure 1:
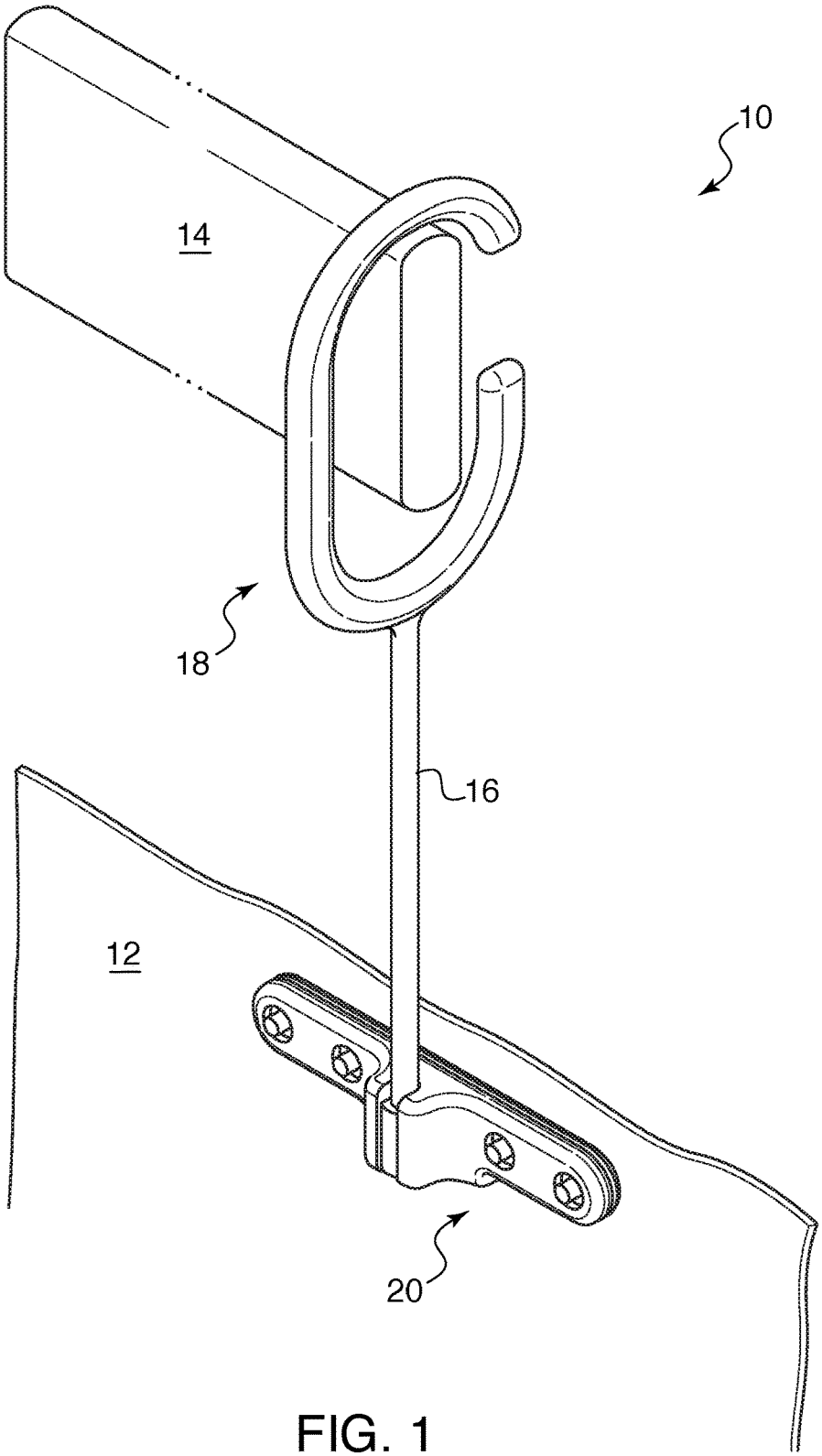
FIG. 1 is a perspective view of an embodiment of a curtain support and swivel assembly hanging from a horizontal support tube and attached to an exemplary hanging material.

Various embodiments of curtain support and swivel systems, methods, and assemblies (and related support structures) are described below in connection with FIGS. 1-14. As an introductory matter, however, an exemplary curtain support and swivel assembly will be briefly described. In an embodiment, the curtain support and swivel design is a two-part assembly comprising a specially configured support rod and a cooperating curtain attachment member. The curtain attachment member is configured to directly attach to a hanging material or, in other embodiments, a header that may be attached to the hanging material. It should be appreciated that the hanging material may comprise any type of textiles, fabrics, cloths, or other flexible materials. Furthermore, depending on the particular application, the hanging material (or the combination of the header and hanging material) may be referred to as a cubicle curtain, a hospital curtain, a privacy curtain, a shower curtain, or more generally as a curtain or drape (collectively referred to as "hanging material" or "a privacy curtain").

The support rod has a support attachment member extending from one end. The support attachment member is configured for quick, easy, and safe attachment to a horizontal support structure. The horizontal support structure may comprise a conventional ceiling-mounted track system or any combination of ceiling and/or wall-mounted tubes or other support(s). In this regard, the support attachment member may comprise, for example, a C-type hook, roller(s), glider(s), or other means for attaching the support rod to the horizontal support structure. Another end of the support rod comprises a stop member configured to be easily attached to and cooperate with the curtain attachment member. The stop member and the curtain attachment member cooperate in use to enable the support rod (which is connected to the horizontal support structure via the support attachment member) to swivel or rotate relative to the curtain attachment member (which is connected to the hanging material or header). In an embodiment, the curtain attachment member comprises a longitudinal opening with a lip. The support rod may be easily inserted into the longitudinal opening such that the stop member engages with the lip and enables the support rod to rotate (e.g., against a bearing surface) within the longitudinal opening.

It should be appreciated that, because the curtain support assembly is allowed to swivel or rotate, the privacy curtain may be installed and removed more quickly, easily, and safely. During use, the swivel or rotation of the curtain support assembly may enable the privacy curtain to be more easily traversed across the horizontal support structure. Furthermore, the swivel or rotation of the curtain support assembly may reduce the forces applied to the support attachment member, the horizontal support structure, the curtain attachment member, and/or the hanging material, which may extend the lifecycle of the system and reduce maintenance costs.

Figure 2:
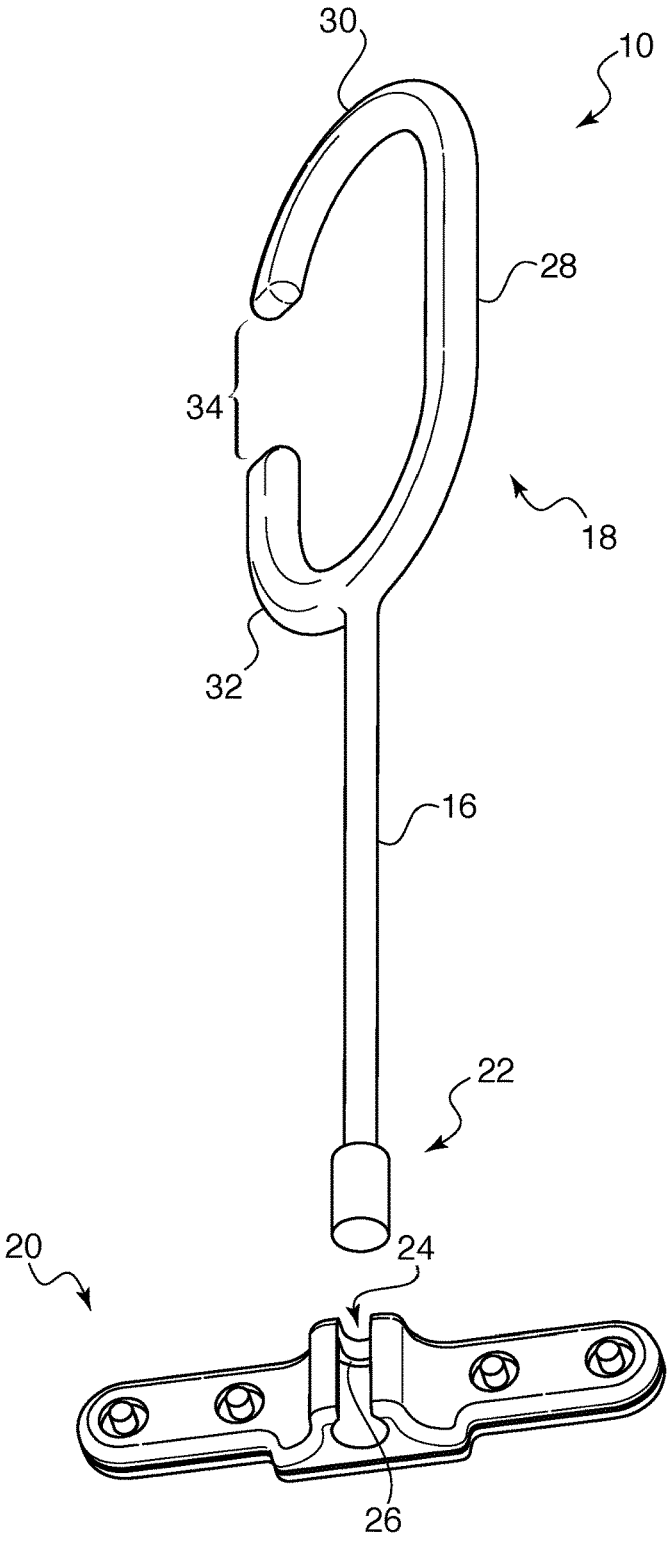
FIG. 2 illustrates the components of the curtain support and swivel assembly illustrated in FIG. 1.

An exemplary embodiment of a curtain support and swivel assembly 10 is illustrated in FIGS. 1 & 2. The curtain support and swivel assembly 10 comprises a support rod 16 and a curtain attachment member 20, which cooperate in use to provide the swivel or rotation feature. A support attachment member 18 extends from one end of the support rod 16. The support attachment member 18 may be integrally formed with the support rod 16. In other embodiments, the support attachment member 18 may be removably attached to the support rod 16 to support various attachments for integration with different types of horizontal support structures. As illustrated in the embodiment of FIG. 1, the support attachment member 18 may comprise a C-type hook for quick, easy, and safe attachment to a horizontal tube 14. As known in the art, the horizontal tube 14 may comprise a series of straight and/or curved sections to define the area to be enclosed by a privacy curtain.

The C-type hook comprises a straight portion 28 with respective curved portions 30 and 32 extending therefrom to define an opening 34. The dimensions of the curved portions 30 and 32, the straight portion 28, and the opening 34 are designed to cooperate with the structure of the horizontal tubing 14. For example, the opening 34 enables the C-type hooks to be easily hung from the installed horizontal tubing 14. The upper curved portion 30 may abut with a top surface of the horizontal tube 14. The length of the curved portions 30 and 32 and the straight portion 28 may be modified to accommodate the height and width of the horizontal tube 14 and provide a stable coupling. It should be further appreciated that the C-type hook may be formed from various desirable materials to provide appropriate friction contact between the support attachment member 18 and the horizontal tube 14. In an embodiment, the C-type hook is formed from a flexible material (e.g., polypropolene) for enabling the curved portions 30 and/or 32 to bend relative to the straight portion 28. The bending or flexing of the curved portions 30 and 32 may increase the opening 34, thereby enabling the C-type hook to be easily installed around the horizontal tube 14.

As best illustrated in FIG. 2, another end of the support rod 16 comprises a stop member 22. The stop member 22 is configured to be easily installed in a longitudinal opening 24 disposed in the curtain attachment member 20. The stop member 22 and the curtain attachment member 20 cooperate in use to enable the support rod 16 (which is connected to the horizontal tube 14 via the support attachment member 18) to swivel or rotate relative to the curtain attachment member 20 (which is attached to the privacy curtain 12, header, or other hanging material). In an embodiment, the longitudinal opening 24 in the curtain attachment member 20 comprises a lip 26. As described below in more detail, the support rod 16 may be easily inserted into the longitudinal opening 24 and slid upward until the stop member 22 abuts the lip 26. The engagement of the stop member 22 and the lip 26 enables the support rod 16 to rotate (e.g., against a bearing surface) within the longitudinal opening 24.

Figure 3:
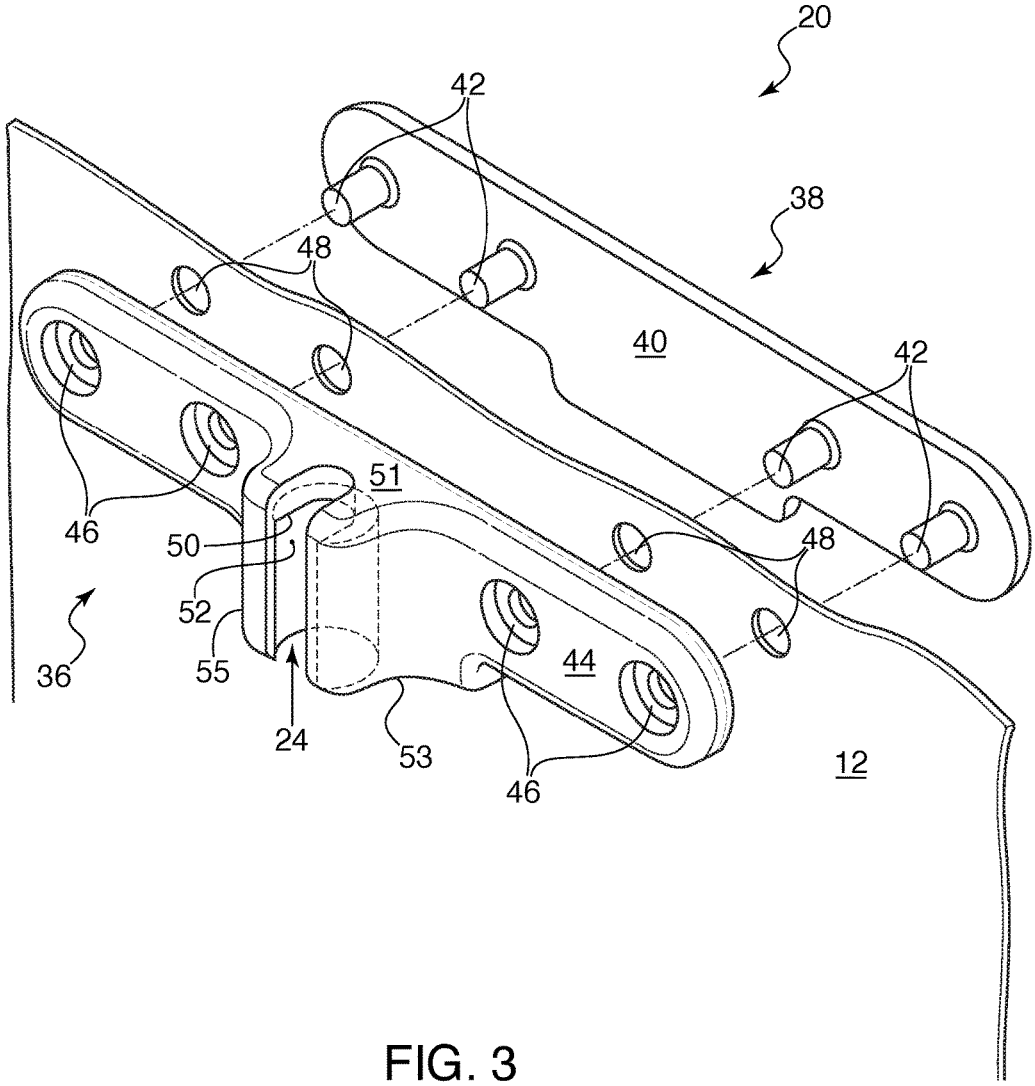
FIG. 3 is a perspective view of an embodiment of a curtain attachment member comprising a front header plate and a back header plate.

It should be appreciated that the stop member 22 disposed on the support rod 16 and the longitudinal opening 24 disposed on the curtain attachment member 20 may be implemented in various ways to provide the swivel or rotation feature. FIG. 3 illustrates an exemplary embodiment of the curtain attachment member 20. In this embodiment, the curtain attachment member 20 comprises a header plate assembly configured to attach to the privacy curtain 12 or a header portion that may be attached to the remaining portion of the privacy curtain 12. As illustrated in FIG. 3, the header plate assembly comprises a front header plate 36 and a back header plate 38. The privacy curtain 12 may be attached between the front and back header plates 36 and 38, respectively. In an embodiment, an inner surface 40 of the back header plate 38 may comprise one or more protruding members (e.g., pegs 42) adapted to be installed through one or more corresponding openings 48 disposed on an upper portion of the privacy curtain 12. The pegs 42 may be further inserted through one or more openings 46 in the front header plate 36. It should be appreciated that the header plate assembly may incorporate any number of protruding members and corresponding openings to accommodate the spacing of the openings 48 along the privacy curtain 12. In the illustrated embodiment, four pegs, plate openings, and curtain openings 42, 46, and 48, respectively, are aligned to provide the attachment of the curtain attachment member 20 to the privacy curtain 12.

With the pegs 42 inserted through the corresponding aligned openings 48 and openings 46, the front header plate 36 and the back header plate 38 may be joined and secured together as illustrated in FIG. 2. In an embodiment, the front and back header plates 36 and 38 may be fixed with fasteners installed on the outer surface 44 of the front header plate 36. It should be appreciated that the securing or fastening of the front and back header plates 36 and 38 with the hanging material 12 may be permanent, semi-permanent, or temporary, which may provide for convenient repair and replacement of the curtain attachment members 20.

In one embodiment, the front and back header plates 36 and 38 with the hanging material may be permanently joined together using a process called heat staking. In this embodiment, the pegs 42 may comprise a rigid material at room temperature (e.g., plastic, polymer, or other thermally-deformable material). After the pegs 42 are inserted through the corresponding aligned openings 48 and 46 and the front and back header plates 36 and 38 are joined together, heat above the glass transition temperature may be applied to the pegs 42. As the pegs 42 melt and deform under the heat and an applied force, the melted material molds into the shape corresponding to the openings 46 such that upon cooling and reforming the rigid material, the assembly is fixed together. The reformed rigid material may be flush with the outer surface 44 on the front header plate 36 and in a tight, secure fit within the opening 46 (e.g., around a securing surface).

As further illustrated in FIG. 3, the longitudinal opening 24 may be disposed on the outer surface 44 of the front header plate 36. In the embodiment of FIG. 3, the longitudinal opening 24 comprises a slotted longitudinal bore formed by a U-shaped member defined by a pair of members 55 and 53 extending out from the outer surface 44. The outer edges of the members 55 and 53 are separated by a lateral distance, which provides an access point for inserting the support rod 16 into the longitudinal opening 24. As best illustrated in FIG. 3 and the cross-sectional callout in FIG. 5*a*, the slotted longitudinal bore may define a curved inner surface 52, which is generally sized and shaped to cooperate with an outer surface 54 of the stop member 22. In this regard, the inner surface 52 provides a bearing surface for engagement with the outer surface 54 of the stop member 22.

In one embodiment, the stop member 22 comprises a cylinder disposed on the end of the support rod 16. The stop member 22 may have a diameter or lateral dimension slightly greater than the end of the support rod 16 to define an abutment surface 56. As illustrated in FIG. 3 and the cross-sectional call-out of FIG. 5*a*, the diameter or lateral dimension of the stop member 22 may be greater than the lateral distance of the slot in the longitudinal bore defined between the members 55 and 53. This relative size and shape enables the support rod 16 to be inserted in the slotted longitudinal bore and slid upward within the longitudinal opening 24 until the abutment surface 56 engages with the lip 50 formed by the members 53 and 55. When the surface 56 and the lip 50 abut each other, the curtain attachment member 20 may hang securely from the horizontal tube 14. In this position, the stop member 22 is fixed within longitudinal opening 24 but with the ability to swivel or rotate relative to the bearing surface 52.

Figure 4:
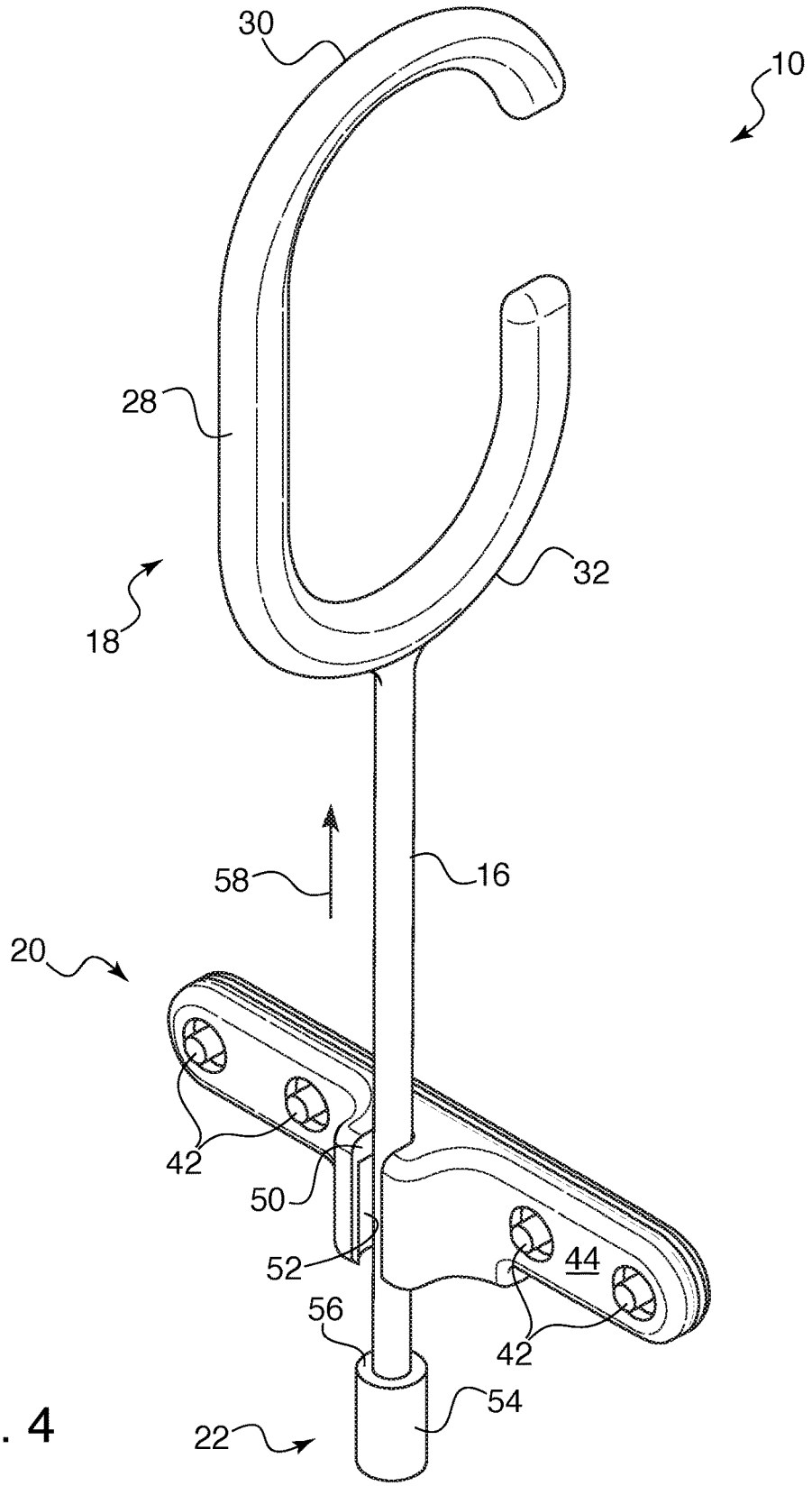
FIG. 4 illustrates an exemplary embodiment of the support rod being inserted into and sliding within the longitudinal opening in the curtain attachment member.
Figure 5:
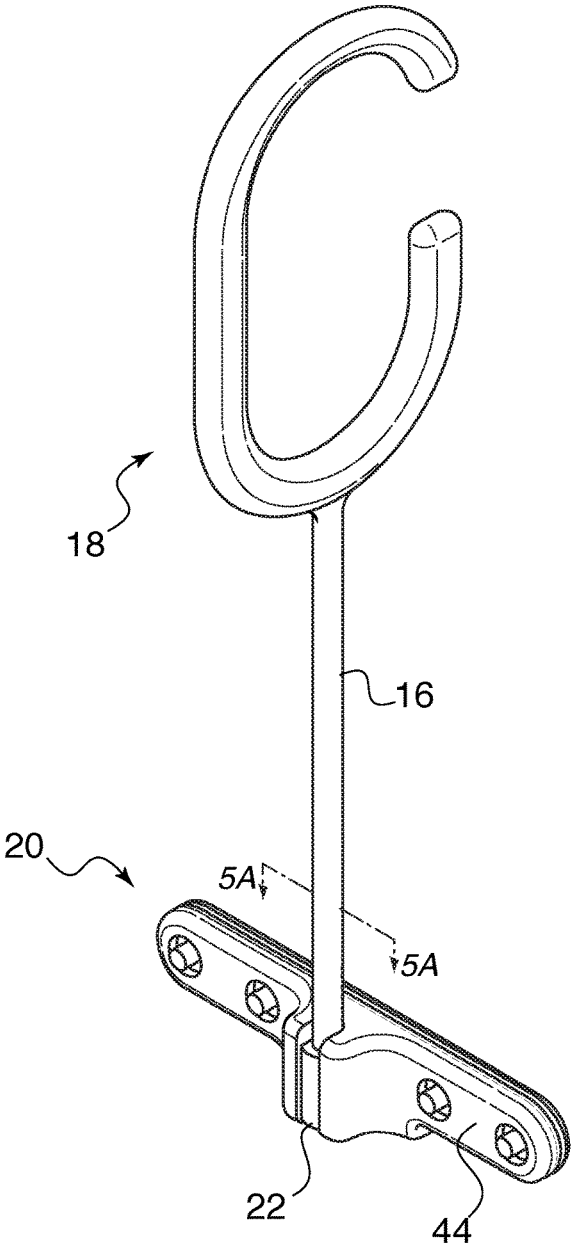
FIG. 5 illustrates the stop member disposed on the end of the support rod engaging with the lip disposed in the longitudinal opening.
Figure 5A:
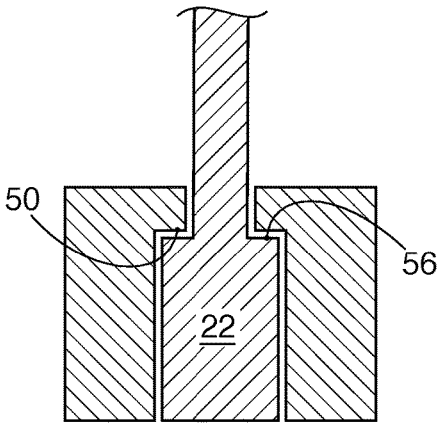
FIG. 5*a* is a cross-sectional view of the stop member and the curtain attachment member along the reference plane 5A in FIG. 5.
Figure 6:
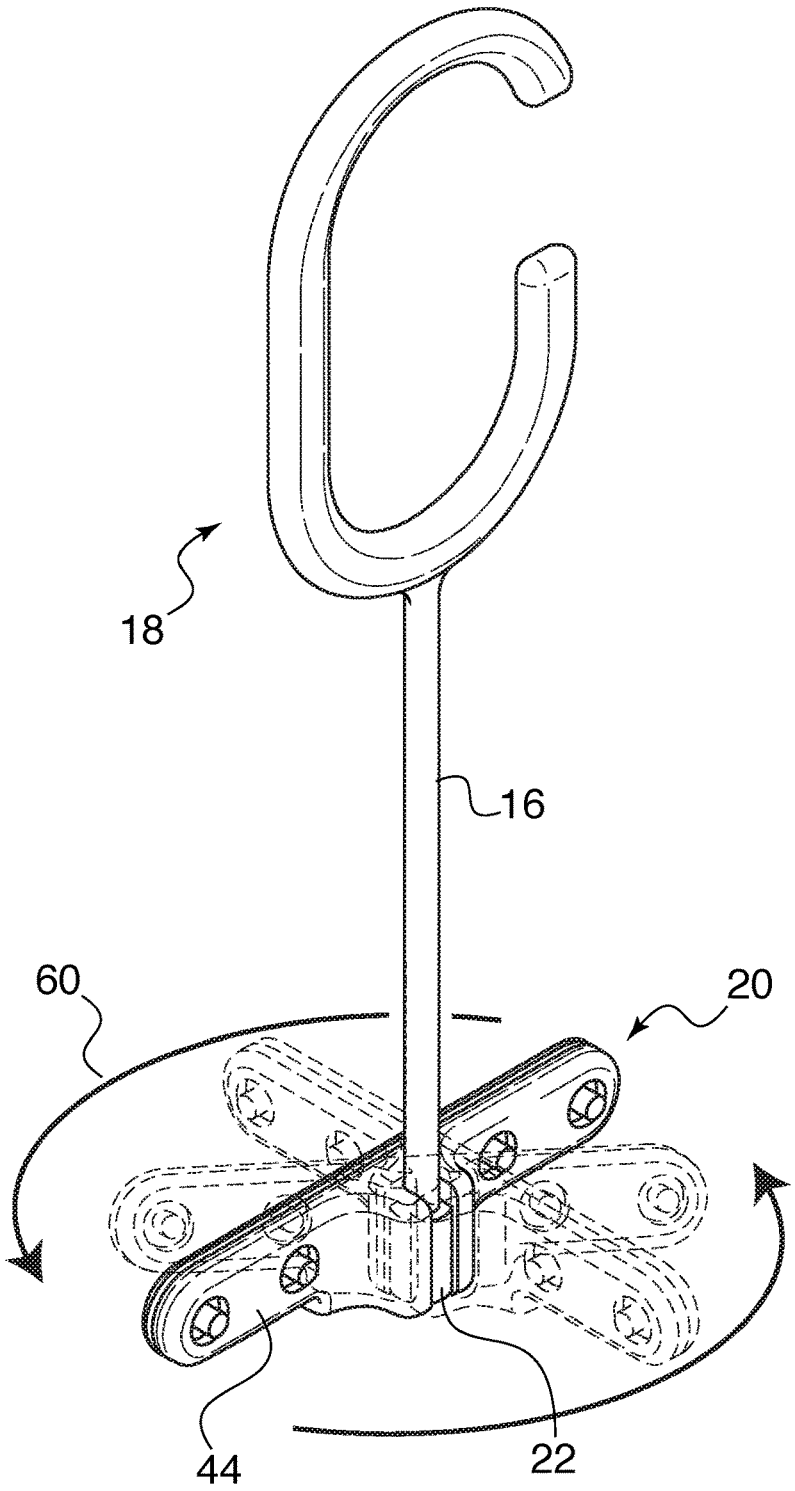
FIG. 6 illustrates the rotation of the stop member relative to the curtain attachment member.

FIGS. 4-6 illustrate an exemplary method for installing an instance of a curtain support and swivel assembly 10. After the curtain attachment member 20 has been attached to the privacy curtain 12 in the manner described above, the curtain attachment member 20 may be lifted upward and the narrower stem of the support rod 16 inserted into the slotted longitudinal bore (FIG. 4). As illustrated by reference numeral 58, the support rod 16 may slide upward in the longitudinal bore relative to the curtain attachment member 20 until the surface 56 and the lip 50 abut each other and the stop member 22 is securely fixed within the longitudinal bore (FIG. 5). The support attachment member 18 (e.g., the C-type hook) may then be attached to the horizontal tube 14. As illustrated in FIG. 6, when the stop member 22 is securely fixed within the longitudinal bore, the curtain attachment member 20 is free to swivel or rotate (reference numeral 60). FIG. 6 illustrates in various shadowed positions that curtain attachment member 22 may swivel or rotate. The structure of the stop member 22 and the cooperating structure of the longitudinal opening 24 may provide a full 360 degrees of rotation around a vertical axis or, in other embodiments, may provide any desirable range of rotation to accommodate desirable use cases.

Regardless of the particular cooperating structures of the stop member 22 and the longitudinal opening 24 for providing the swivel or rotation feature, it should be appreciated that the stop member 22 may be "locked" within the longitudinal opening 24 such that it cannot separate or "pop out" from the curtain attachment member 20 in use. For example, as best illustrated in FIG. 5, the stop member 22 may be secured or "locked" in a vertical position within the longitudinal opening 24. Under the load of the privacy curtain 22, further vertical displacement along the sliding arrangement (arrow 58—FIG. 4) may be prevented due to, for example, the engagement of the abutment surface 56 against the lip 50. It should be further appreciated that the slotted longitudinal bore in the opening 24 comprises a slotted structure that at least partially encloses the stop member 22 and prevents the stop member 22 from displacing laterally or horizontally and becoming separated from the curtain attachment member 20. For example, the structure defining the curved inner surface 52 and providing engagement with the outer surface 54 of the stop member 22 prevents the stop member 22 from moving laterally or horizontally and becoming separated from the curtain attachment member 20 in use.

It should be further appreciated that alternative cooperating structures between the stop member 22 and the curtain attachment member 20 may be used to secure the structures in a stable or locked position while also enabling the curtain attachment member 20 and the stop member 22 to swivel or rotate relative to each other in use and/or under the load of the privacy curtain 12. Furthermore, during installation, the support attachment member 18 may be initially attached to the horizontal tube 14 before inserting the support rod 16 into the slotted longitudinal bore. In either case, this process may be repeated for each curtain support and swivel assembly 10 to complete the installation of the privacy curtain 12, as well as reversed to remove the privacy curtain 12.

Figure 7:
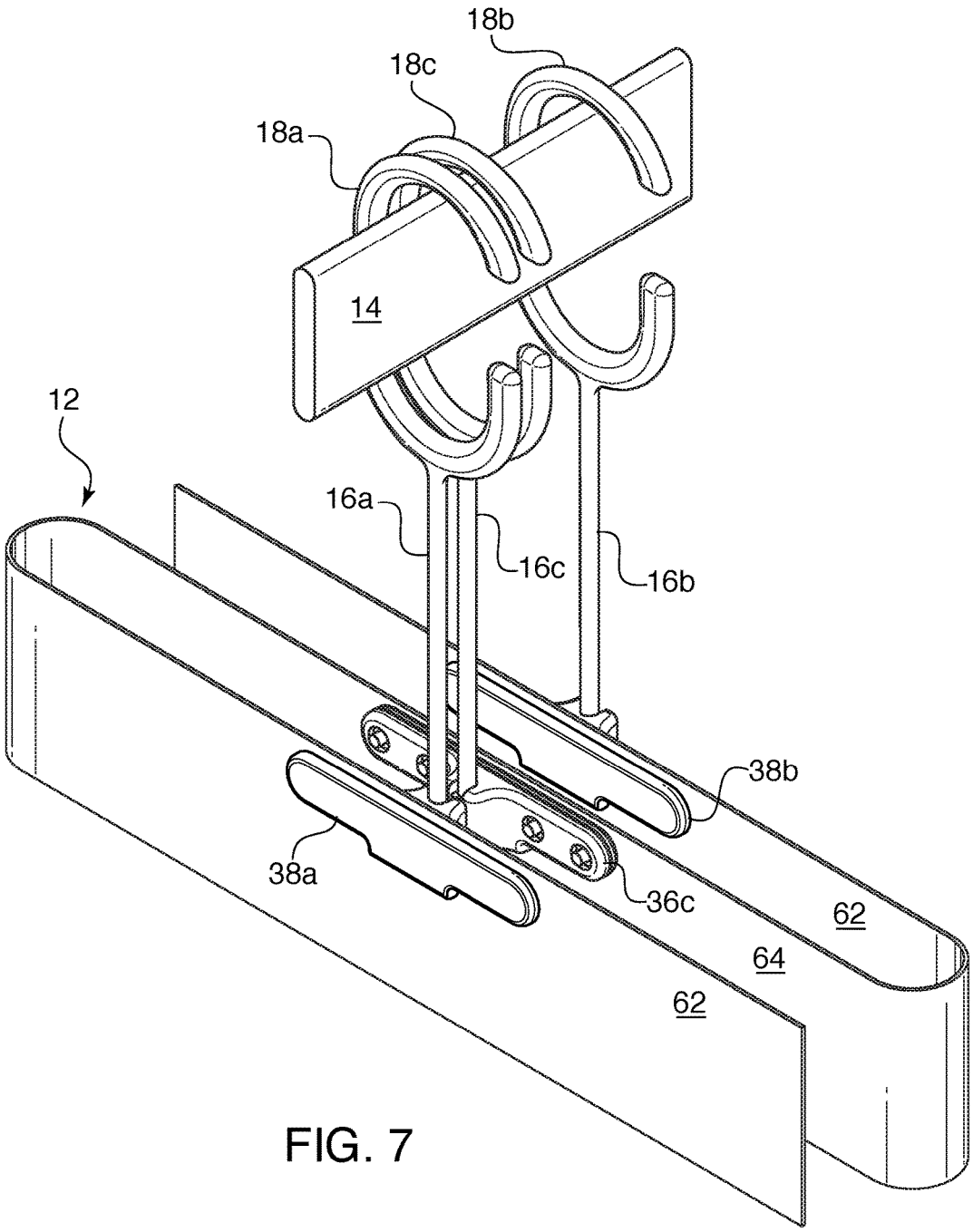
FIG. 7 is a perspective view illustrating an exemplary use case of the curtain support and swivel assembly design with a foldable hanging material.
Figure 8:
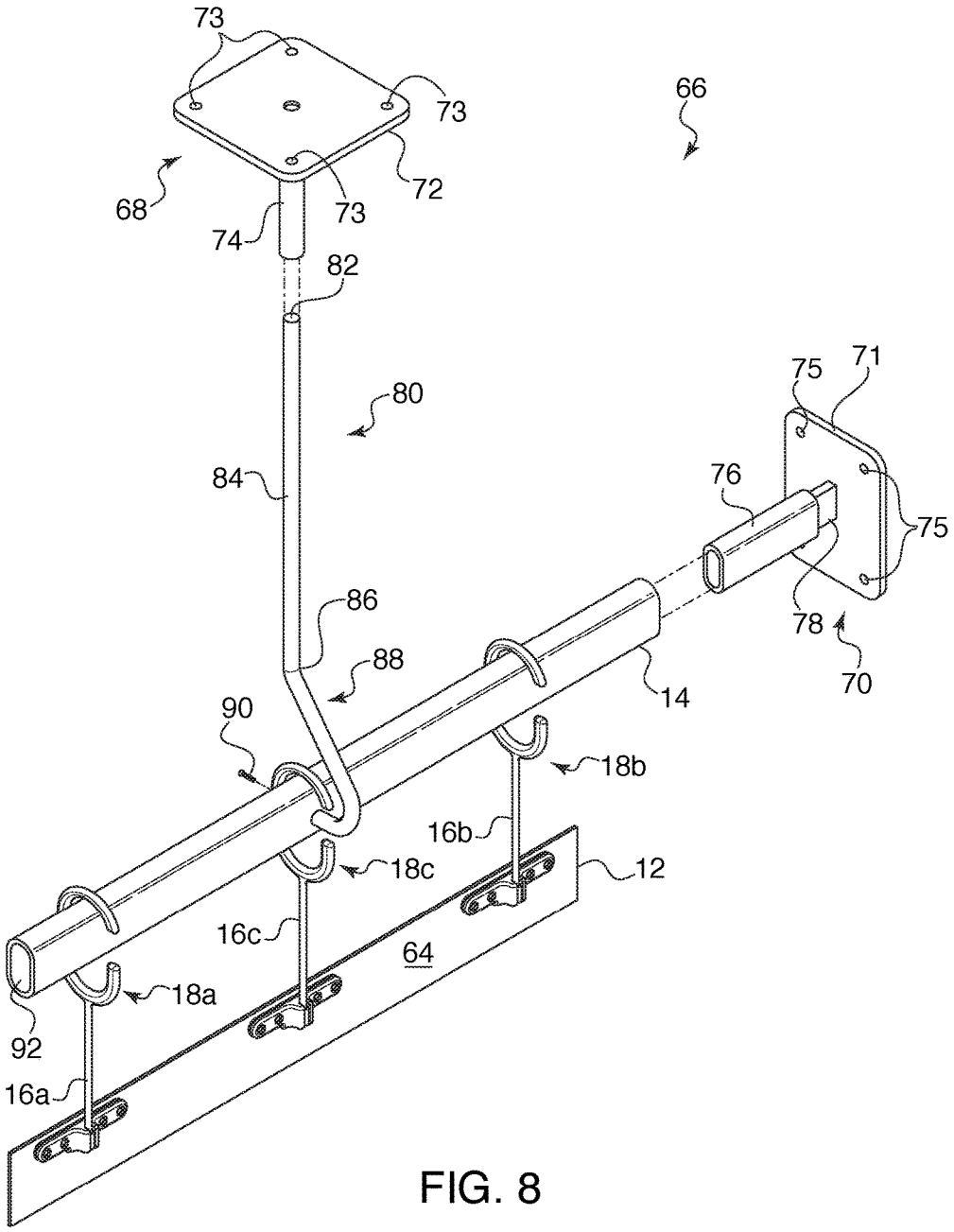
FIG. 8 is a perspective view illustrating an embodiment of a wall and/or ceiling mounted support structure in combination with the curtain support and swivel assembly design.

FIG. 7 is a perspective view illustrating an exemplary use case of the curtain support and swivel assembly design 10 with a foldable, accordion-type privacy curtain 12. FIG. 7 shows a portion of the implementation comprising a series of three curtain support and swivel assemblies 10*a*, 10*b*, and 10*c*. Because the support rods 16*a*, 16*b*, and 16*c* are free to swivel or rotate relative to their corresponding curtain attachment members 20*a*, 20*b*, and 20*c*, the privacy curtain 12 may be conveniently and aesthetically disposed in the accordion arrangement of FIG. 7 when closed. In this accordion arrangement, adjacent curtain attachment members 20 are rotated approximately 180 degrees from each other while the C-type hooks 18*a*, 18*b*, and 18*c* remain attached to the horizontal tube 14. As illustrated in FIG. 7, the header plate assemblies 36*a*/38*a*, 36*b*/38*b*, and 36*c*/38*c* are rotated relative to their respective support rods 16*a*, 16*b*, and 16*c* such that the adjacent front header plates 36*a* and 36*c* generally face each other and the adjacent back header plates 38*b* and 38*c* generally face each other. Each curtain attachment member 20*a*, 20*b*, and 20*c* is permitted to rotate to a position generally perpendicular to the horizontal support tube 14 to provide a more compact closed position of the privacy curtain 12. In this manner, the lateral members or wings of the front and back header plates 36 and 38 may cause the curtain segments to accordion for storage and keep them from sagging when being used.

As mentioned above, the curtain support and swivel assembly design 10 may be integrated with various types of wall and/or ceiling-mounted support structures that provide a horizontal support structure for attaching the support attachment member 18. FIGS. 8-11 illustrate an embodiment of a wall and/or ceiling mounted support structure 66 in combination with the curtain support and swivel assembly design 10. The horizontal support tube 14 to which the curtain support and swivel assemblies 10*a*, 10*b*, and 10*c* are attached may be supported by a ceiling mount assembly 68 and a wall mount assembly 70.

Figure 9:
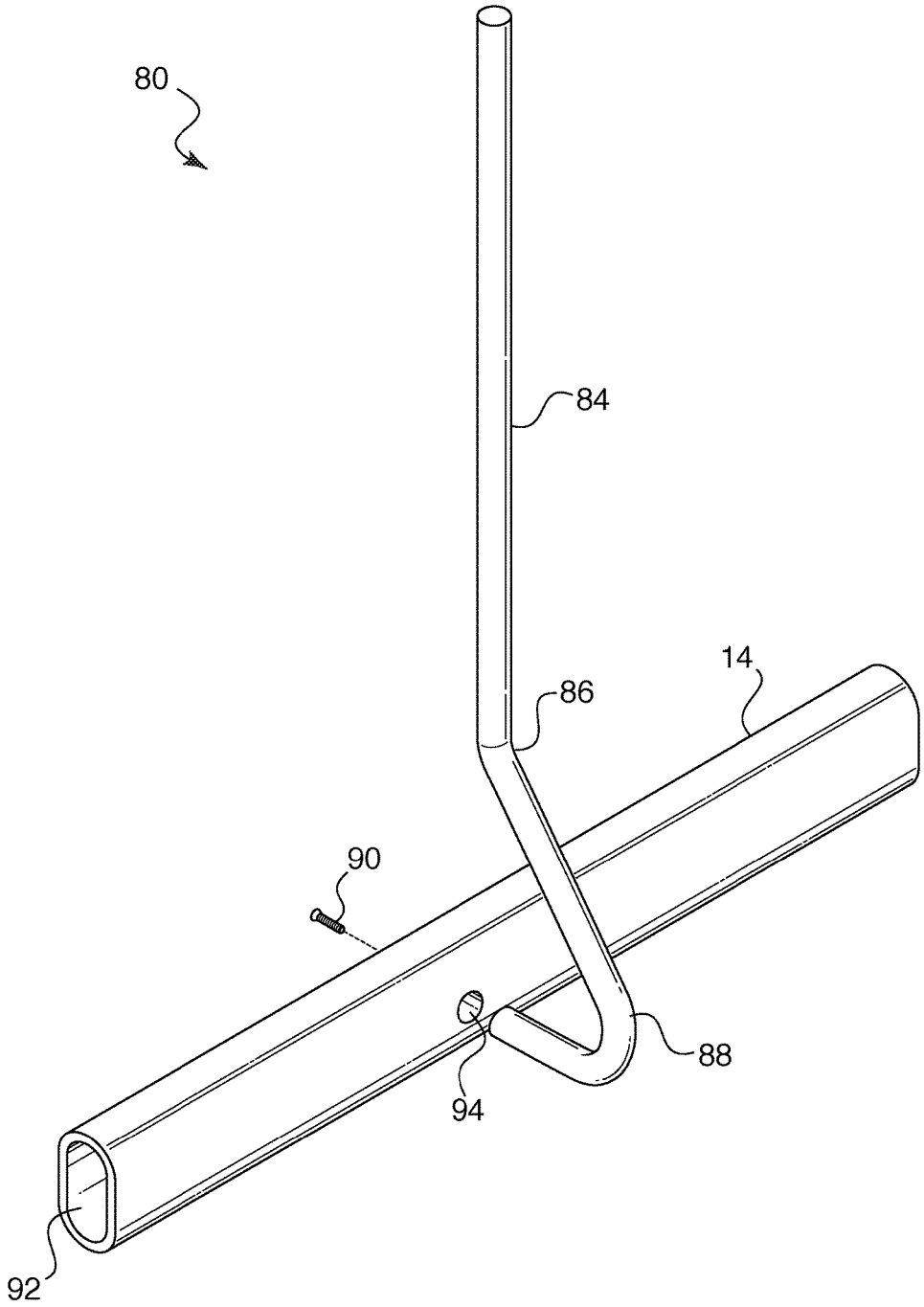
FIG. 9 illustrates an exemplary embodiment for connecting the drop-tube assembly with the horizontal support tube.
Figure 10:
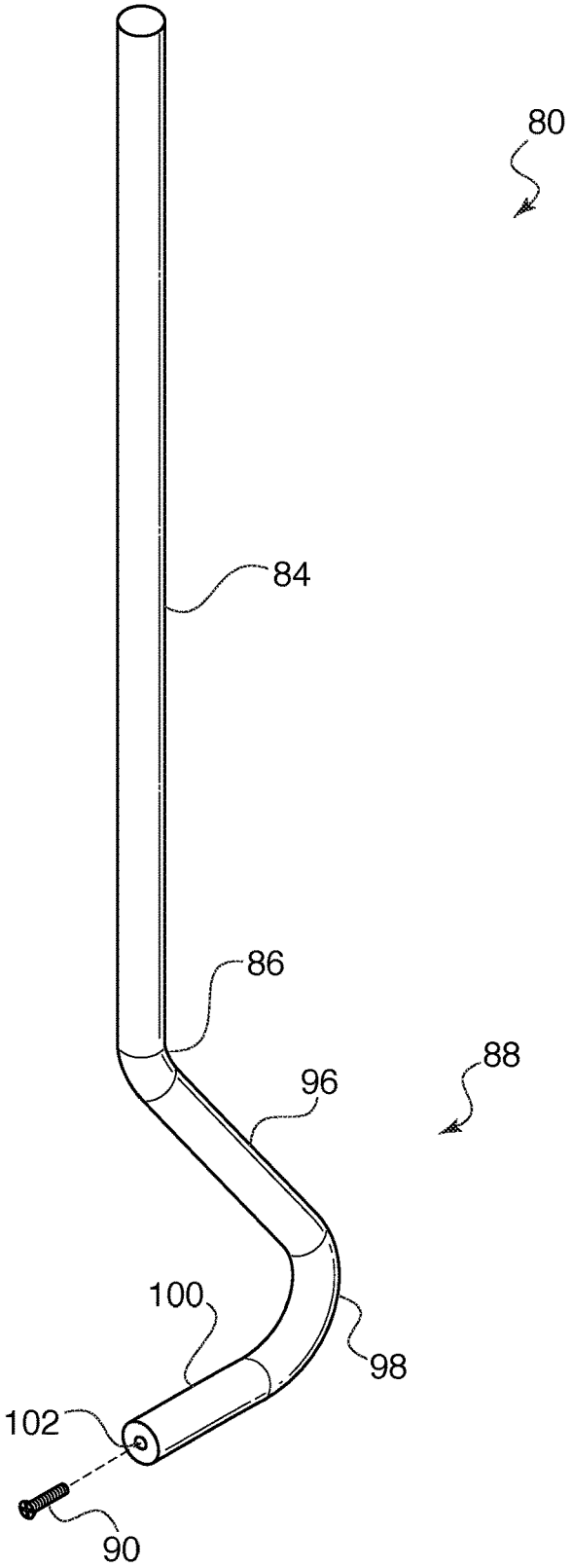
FIG. 10 illustrates an exemplary method for attaching the drop-tube assembly to the horizontal support tube.
Figure 11:
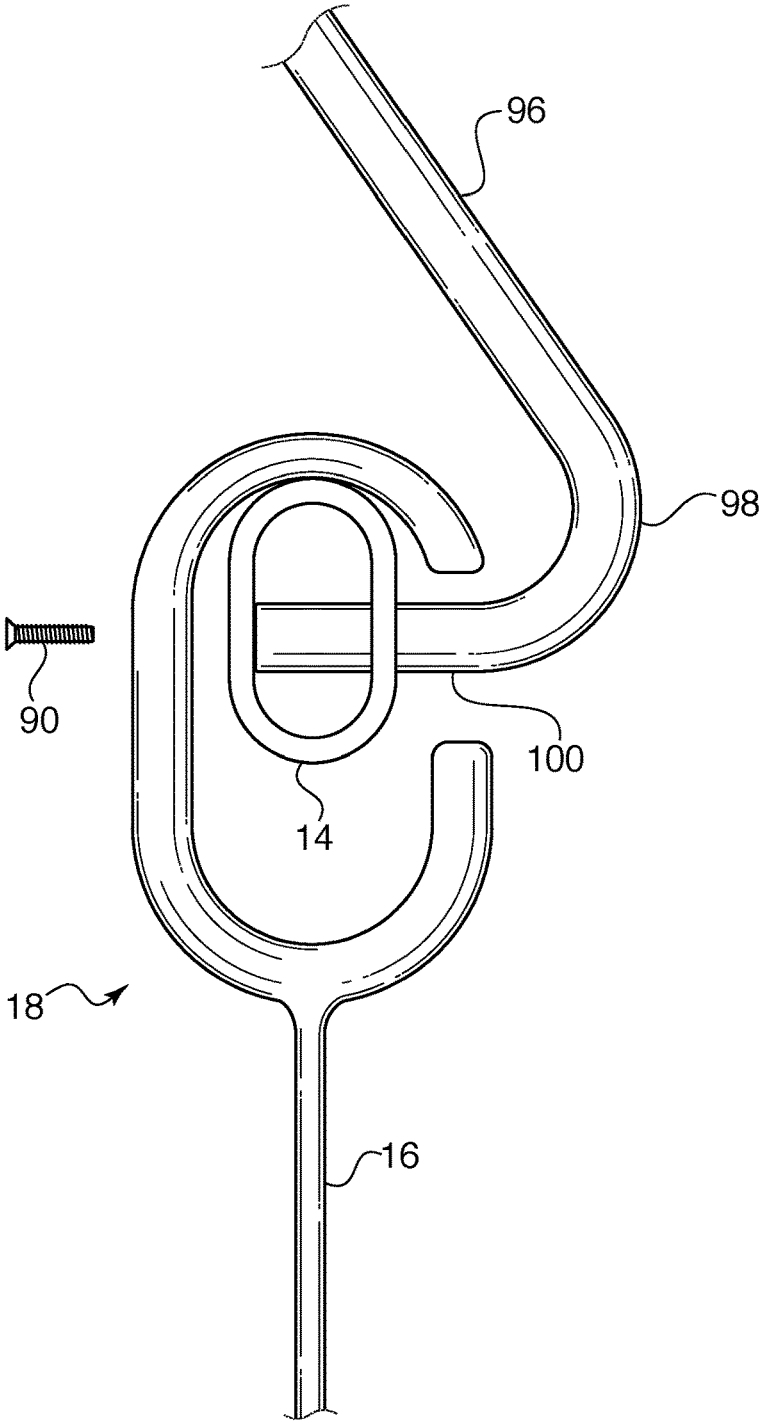
FIG. 11 is a cross-sectional view illustrating the operational cooperation of an embodiment of the support attachment member of the curtain support and swivel assembly with the horizontal support tube.

The ceiling mount assembly 68 comprises a ceiling plate 72 that may be fixed to the ceiling via holes 73. The ceiling plate 72 has a tube section 74 extending downward. The tube section 74 may be fixed to an end 82 of a specially-configured drop-tubing 80 that may be fixed to the horizontal tubing 14. The drop-tubing 80 comprises a down tube section 84 and a generally C-shaped curved section 88. The curved section 88 is configured to provide a clearance angle for enabling the C-type hooks to freely move along the horizontal tube 14 (see FIG. 11). As best illustrated in FIG. 10, the curved section 88 comprises straight sections 96 and 100 and curved sections 98 and 96. The curved section 96 extends away from the straight portion 84 at a first angle (e.g., approximately 45 degrees). The curved section 98 reroutes the curved section 88 to a horizontally disposed straight section 100. The straight section 100 may include a threaded hole 102 for securing to the horizontal tubing 14. As illustrated in FIG. 9, the straight section 100 may be inserted through an opening 94 in the horizontal tubing 14 and secured via, for example, a screw 90.

Referring again to FIG. 8, the wall mount assembly 70 comprises a wall plate 71 that may be fixed to a wall or other structure via holes 75. The wall plate 70 may include a horizontal member 78 comprising an adapter section 76 for form-fitting to the horizontal tubing 14. It should be appreciated that the specially-configured drop-tubing 80 provides for unobstructed traversal of the C-type hooks 18 across the horizontal support tubing 14. The length of the drop-tubing 80 may be customized based on the height of the ceiling for disposal at a convenient height off of the floor to allow easy installation, removal, and sliding of the privacy curtain 12.

The drop-tubing 80 may provide various benefits including, for example, the ability to provide flexibility during custom installations that may reduce installation costs, maintenance costs, and/or improve operation. As mentioned above, conventional cubicle curtain tracks are typically mounted directly and flush to the ceiling. Therefore, the track must avoid areas that have lights, air conditioning vents, fire safety sprinklers, or any other obstacle. This may limit where the track may be located, leading to increased materials and installation costs. The drop-tubing 80 in combination with the curtain support and swivel assembly design 10 may provide various benefits and/or advantages over conventional track systems. For example, the ceiling mounted assembly 68 and the drop-tubing 80 may be advantageously located to accommodate any ceiling mounted obstacles. Furthermore, if the facility in which the system is being installed has different ceiling heights throughout, the lengths of the drop-tubing 80 may be adjusted to maintain the horizontal tubing 14 at a fixed distance from the floor. This would afford the additional benefit of enabling a standard length of privacy curtain 12 throughout the facility. Because the length of the privacy curtain 12 and the drop-tubing 80 may be customized, the horizontal tubing 14 may be advantageously disposed at a height from the floor that is more easily accessed without a ladder should maintenance be required, which may be safer, more efficient, and reduce maintenance costs.

Figure 12:
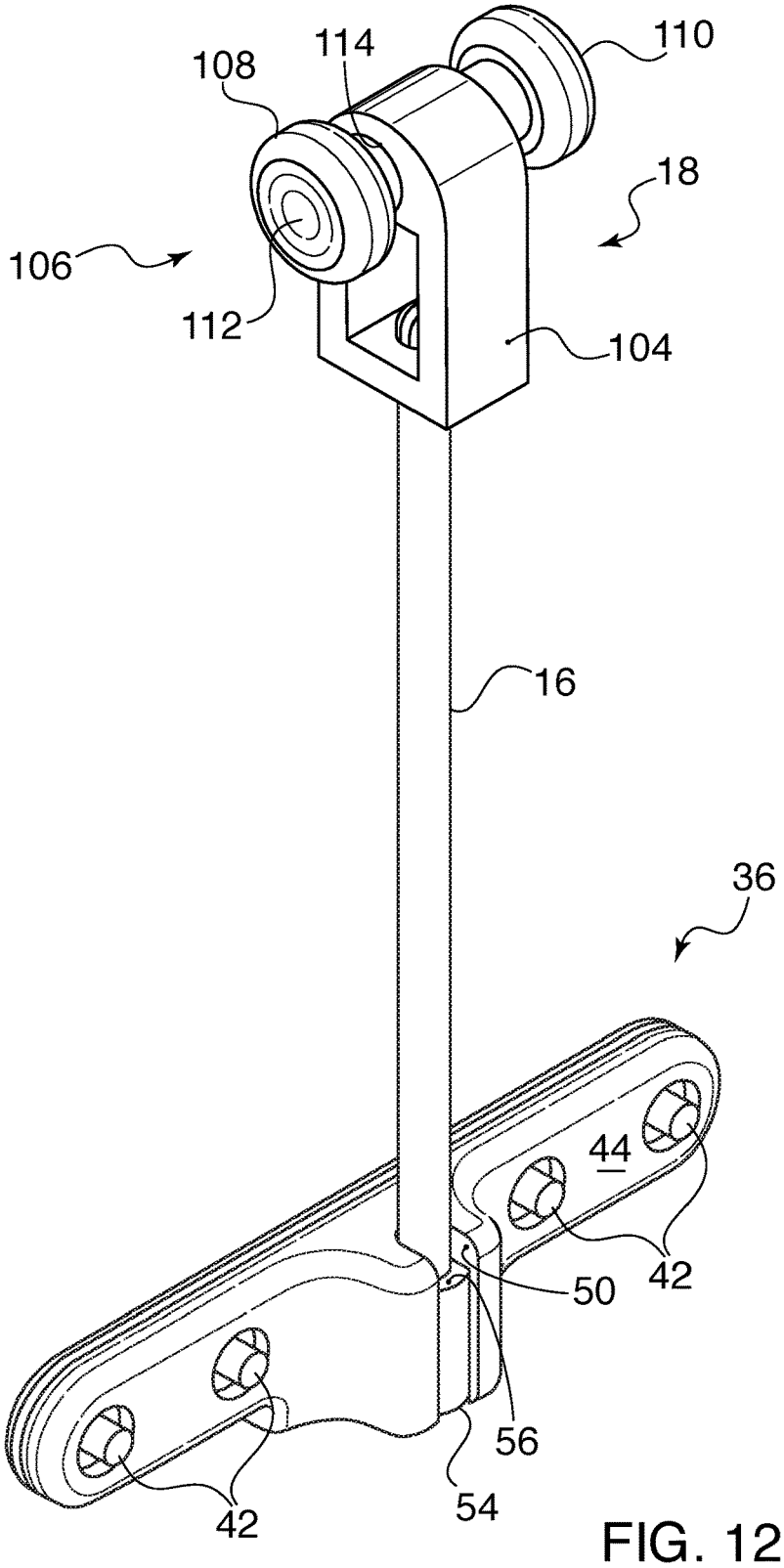
FIG. 12 is a perspective view illustrating another embodiment of a support attachment member for use with the curtain support and swivel assembly.
Figure 13:
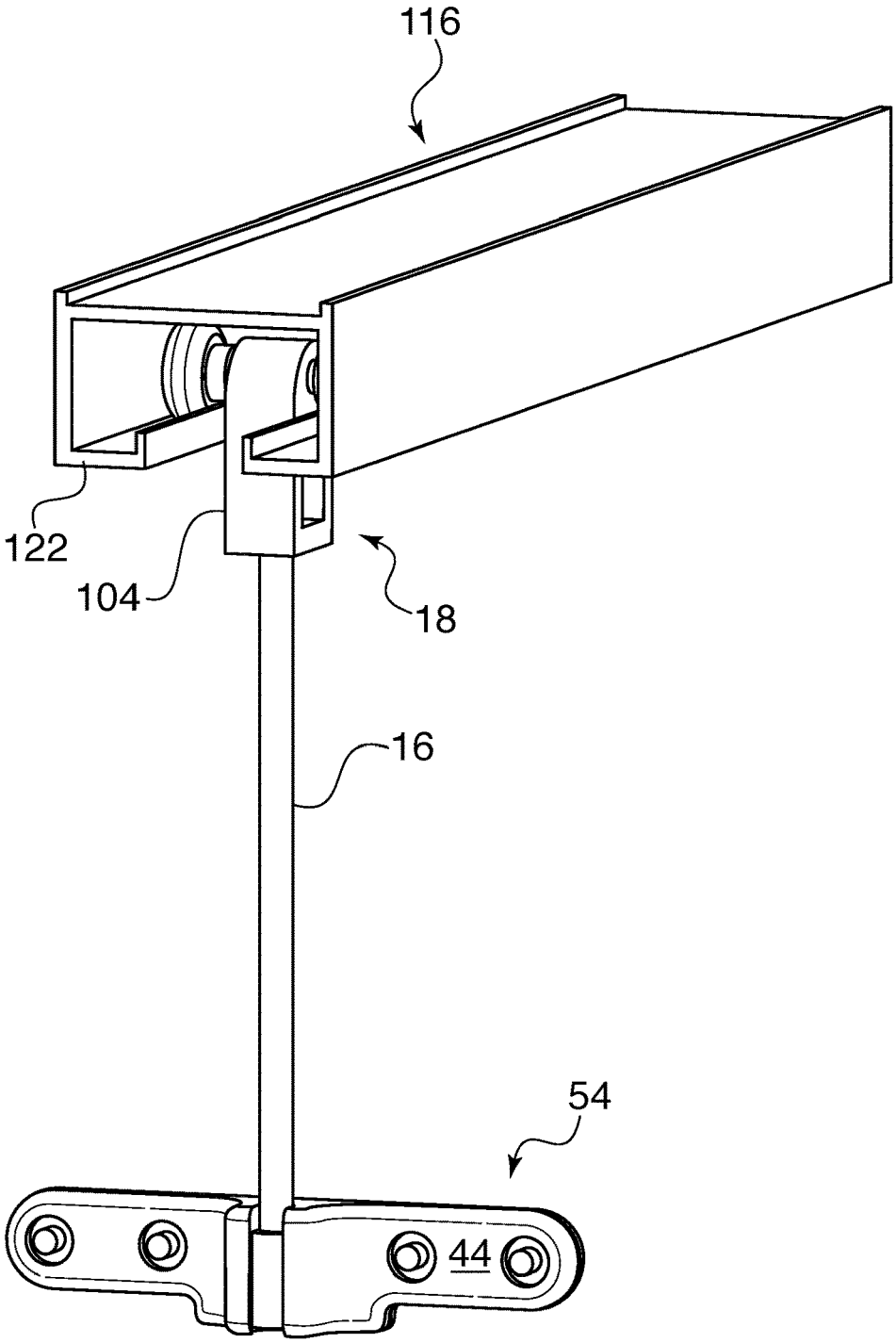
FIG. 13 illustrates the support attachment member of FIG. 12 installed in an exemplary track-type support system.
Figure 14:
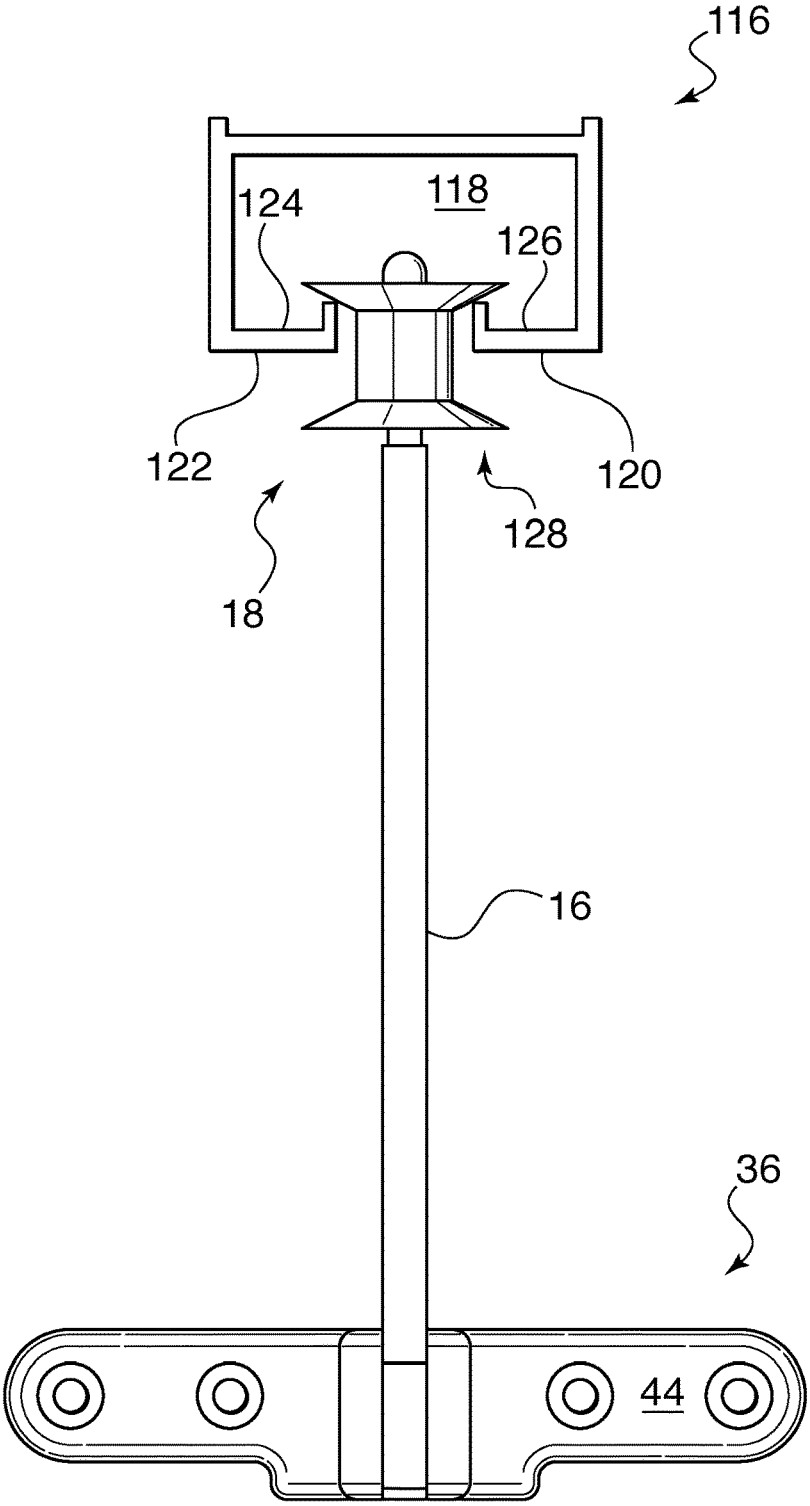
FIG. 14 illustrates a further embodiment of a support attachment member for use with the curtain support swivel/assembly and a track-type support system.

FIGS. 12-14 illustrate additional embodiments of a support attachment member 18 disposed on the support rod 16 for use with a conventional ceiling-mounted track-type system. FIG. 12 illustrates an embodiment of a roller assembly 106, which may be installed in a track 116 comprising, for example, an extruded aluminum or other channel(s) 120 and 122. The roller assembly 106 may be fixed or removably attached to an end of the support rod 16. As illustrated in FIG. 12, the roller assembly 106 comprises a housing 104 for supporting one or more rollers 112 and 110. The rollers 110 and 112 may rotate around a horizontal axis 114. As illustrated in FIG. 13, the rollers 110 and 112 may be installed within and freely traverse the two channels 120 and 122 in the track 116. It should be appreciated that the housing 104 may support various types of roller(s) and or glider(s). FIG. 14 illustrates another embodiment of a roller assembly 128 for use with the track 116. In this embodiment, the roller assembly 128 rotates around the support rod axis. The roller assembly 128 may include an upper member that makes contact with channel members 124 and 126 for enabling the roller assembly to traverse channels 122 and 120, respectively, within the track opening 118.

It should be appreciated that the support attachment member 18 may be retrofitted as either a glider or roller so that many of the benefits received from the curtain support and swivel assembly 10 may be used on existing ceiling-mounted channel tracks. In this regard, if an existing facility does not want to replace the existing ceiling-mount channel track system, the curtain support and swivel assembly 10 will still afford an improved systems that offers easy and quick removal and replacement of curtains without the problems associated with typical curtain hooks.

Alternative embodiments will become apparent to one of ordinary skill in the art to which the invention pertains without departing from its spirit and scope. Therefore, although selected aspects have been illustrated and described in detail, it will be understood that various substitutions and alterations may be made therein without departing from the spirit and scope of the present invention, as defined by the following claims.

What is claimed is:

1. A curtain support assembly comprising:

a support attachment member configured to be removably attached to a fixed horizontal support structure;

a rod having a longitudinal axis and extending downward from the support attachment member;

a stop member disposed on an end of the rod opposite the support attachment member; and a curtain attachment member having a longitudinal opening with a lip, the longitudinal opening further comprising a longitudinal slot for receiving the rod during assembly of the curtain support assembly and receiving the stop member after assembly of the curtain support assembly, the longitudinal slot extending along an entire length dimension of the curtain attachment member that includes the longitudinal opening and lip, the longitudinal slot having a width dimension that is less than a diameter of the stop member but greater than a diameter of the rod, wherein the stop member is configured to be inserted into and received within the longitudinal opening and positioned such that the stop member is configured to engage with the lip and rotate within the longitudinal opening relative to the longitudinal axis of the rod.

2. The curtain support assembly of claim 1, wherein the support attachment member comprises a hook configured for removable attachment to the fixed horizontal support structure a horizontal support tube.

3. The curtain support assembly of claim 1, wherein the support attachment member comprises one of a roller or a glider configured to be installed in a track.

4. The curtain support assembly of claim 1, wherein the support attachment member is removably fixed to the rod.

5. The curtain support assembly of claim 1, wherein the curtain attachment member is configured to attach to a hanging material.

6. The curtain support assembly of claim 1, wherein the curtain attachment member comprises a header plate configured to attach to a header portion of a hanging material.

7. The curtain support assembly of claim 1, wherein the curtain attachment member comprises a header assembly.

8. The curtain support assembly of claim 7, wherein the header assembly comprises:

a first header plate comprising the longitudinal opening; and a second header plate configured to be secured to the first header plate.

9. The curtain support assembly of claim 8, wherein one of the first and second header plates comprises one or more openings, and the other of the first and second header plates comprises one or more protruding members to be inserted through one or more openings disposed on a hanging material and the one or more openings.

10. The curtain support assembly of claim 1, wherein the longitudinal opening comprises a longitudinal bore defining a bearing surface and having the longitudinal slot.

11. The curtain support assembly of claim 10, wherein the stop member comprises a cylindrically shaped member defining an upper ledge adjacent the end of the rod, wherein at least a portion of an outer surface of the cylindrically shaped member is configured to rotatably engage with the bearing surface when the upper ledge abuts the lip.

12. The curtain support assembly of claim 11, wherein the longitudinal slot has a lateral distance greater than a diameter of the rod and less than a diameter of the cylindrically shaped member such that the rod may be inserted into the longitudinal slot and positioned upward until the upper ledge abuts the lip.

13. The curtain support assembly of claim 1, wherein the stop member is fixed to the end of the rod.

14. A curtain support assembly comprising:

a rigid support rod having a first end configured for removable attachment to a horizontal support structure and a second end comprising a stop member; and a curtain attachment member configured for attachment to a curtain and having a longitudinal opening with a lip, the longitudinal opening further comprising a longitudinal slot for receiving the rod during assembly of the curtain support assembly and receiving the stop member after assembly of the curtain support assembly, the longitudinal slot extending along an entire length dimension of the curtain attachment member that includes the longitudinal opening and lip, the longitudinal slot having a width dimension that is less than a diameter of the stop member but greater than a diameter of the rod, wherein the stop member is configured to be received within the longitudinal opening and positioned such that the stop member engages with the lip and enables the rigid support rod to rotate within the longitudinal opening.

15. The curtain support assembly of claim 14, wherein the first end of the rigid support rod comprises a C-type hook configured for removable attachment to a horizontal support tube.

16. The curtain support assembly of claim 14, further comprising one of a roller and a glider configured to be installed in a ceiling-mounted track.

17. The curtain support assembly of claim 14, wherein curtain attachment member comprises a header assembly comprising: a first header plate comprising the longitudinal opening; and a second header plate configured to be secured to the first header plate with a hanging material fixed in between.

18. The curtain support assembly of claim 17, wherein one of the first and second header plates comprises one or more openings, and the other of the first and second header plates comprises one or more protruding members to be inserted through one or more openings disposed on the hanging material and the one or more openings.

19. The curtain support assembly of claim 14, wherein the longitudinal opening comprises a longitudinal bore defining a bearing surface and having the longitudinal slot.

20. The curtain support assembly of claim 19, wherein the stop member comprises a cylindrically shaped member defining an upper ledge adjacent the second end of the rigid support rod, wherein at least a portion of an outer surface of the cylindrically shaped member is configured to rotatably engage with the bearing surface when the upper ledge abuts the lip.

* * * * *